United States Patent [19]

Skolaude et al.

[11] Patent Number: 4,555,256

[45] Date of Patent: Nov. 26, 1985

[54] PROCESS AND DEVICE FOR THE PRODUCTION OF GASEOUS OXYGEN AT ELEVATED PRESSURE

[75] Inventors: Werner Skolaude, Munich; Gunnar Eggendorfer, Grunwald, both of Fed. Rep. of Germany

[73] Assignee: Linde Aktiengesellschaft, Hollriegelskruth, Fed. Rep. of Germany

[21] Appl. No.: 490,359

[22] Filed: May 2, 1983

[30] Foreign Application Priority Data

May 3, 1982 [DE] Fed. Rep. of Germany ..... 3216510
May 3, 1982 [DE] Fed. Rep. of Germany ..... 3216502

[51] Int. Cl.[4] ..... F25J 3/04

[52] U.S. Cl. ..... 62/18; 62/25; 62/29; 62/31; 62/38

[58] Field of Search ..... 62/9, 11, 23, 24, 25, 62/27, 28, 29, 31, 34, 38, 39, 43, 18

[56] References Cited

U.S. PATENT DOCUMENTS 4,372,764 2/1983 Theobald ..... 62/38

*Primary Examiner*—Frank Sever
*Attorney, Agent, or Firm*—James C. Wray

[57] ABSTRACT

In the production of gaseous oxygen, a process and apparatus is used which requires low temperature rectification of air. The air is compressed, purified and cooled in a first heat exchanger while a second gas stream is compressed to elevated pressure, and is cooled in a second heat exchanger. Liquid oxygen removed from rectification is pressurized to a desired pressure and is evaporated and heated in heat exchange with the compressed gas stream.

24 Claims, 12 Drawing Figures

PROCESS AND DEVICE FOR THE PRODUCTION OF GASEOUS OXYGEN AT ELEVATED PRESSURE

BACKGROUND OF THE INVENTION

The invention relates to a process for obtaining gaseous oxygen at elevated pressure by way of low temperature rectification of air, in which the air is compressed, purified, and at least in part, is cooled in a first heat exchanger in heat exchange with rectification product and is passed to the rectication, while a second gas stream is compressed to elevated pressure, is cooled in a second heat exchanger in heat exchange with rectification product, is expanded and likewise is passed into the rectification, and in which process, liquid oxygen is removed from the rectification, pumped to the desired pressure and then is evaporated and heated in heat exchange with the compressed gas stream, which is at elevated pressure; the invention also relates to a device for carrying out the process.

Such process is known from German Laid Open Patent Application No. 25 57 453. Liquid oxygen is removed from the rectification, is compressed to the desired elevated pressure and subsequently is evaporated and heated. Elevated pressure is meant to be superatmospheric pressure here. The heat required for evaporation and heating of the oxygen is supplied by a compressed stream of air. Due to their different physical properties, the temperature curves of oxygen and air differ in the heat exchange. The resultant relatively large temperature differences at the cold end of the second heat exchanger translate into a loss of energy.

This process, which is known as "internal compression" (Innenverdichtung) for the production of oxygen gas under pressure, is thus relatively costly in terms of energy. It has the advantage, however, that the compression of liquid oxygen can be effected with a greatly reduced risk of fire when compared to the more energy efficient process with "external compression" (Aussenverdichtung) of the oxygen, in which the oxygen is withdrawn in gaseous form, essentially without pressure, from the rectification and is then heated and compressed to the required output pressure.

It is the objective of the invention to provide a process of the kind initially described, in which the energy requirements for the production of oxygen are reduced.

The inventive process achieves this objective in that a third partial gas stream to be fractionated is cooled in heat exchange with product to be fractionated.

SUMMARY OF THE INVENTION

In a preferred embodiment of the inventive process, part of the compressed purified air is cooled in the first heat exchanger, as a third gas stream, then is removed therefrom, at least in part, at an intermediate point, and is engine-expanded, and heat is being transferred from an intermediate point of the second heat exchanger to an intermediate point of the first heat exchanger.

In this process, the excess heat which becomes available at the cold end of the second heat exchanger is utilized for refrigeration. The temperature difference at the cold end of the second heat exchanger is reduced by the withdrawal of heat at an intermediate point. The heat withdrawn is returned to the first heat exchanger, so that less air is required for the heating at the cold part. This saved portion of incoming air is being withdrawn from the first heat exchanger before its cooling process is completed. The partial air stream, referred to as the third gas stream, is engine expanded, which results in refrigeration. The entrance temperature during expansion is being determined by the closest temperature differential in the second heat exchanger.

In a process, in which as an additional product stream, a low pressure gas stream from the rectification, particularly nitrogen, is passed through the two heat exchangers for heating, the additional heat provided in the first heat exchanger by the inventive process, facilitates the passage of a larger quantity of gas therein, in favor of a smaller quantity of gas in the second heat exchanger. This means that the quantity of the second gas stream in the second heat exchanger, which is being compressed to a relatively high pressure, can be reduced, which nets further energy savings. Furthermore, energy losses at the warm end of the second heat exchanger are decreased by the reduction of the flow quantity.

According to an advantageous refinement of the inventive process, the third gas stream is further compressed before cooling.

The further compression not only results in a more significant pressure drop, but at the same time produces an equal refrigeration effect at reduced gas quantity, which means that the main compressor for the feed air may also be smaller. Another advantage is that a lower final temperature is achieved in the expansion, with an improved rectification yield.

Advantageously, after expansion, the third gas stream is passed into the rectification and/or into the nitrogen withdrawn from the rectification.

In a preferred embodiment of the invention, the third gas stream is withdrawn essentially at that point of the first heat exchanger where heat is added.

In another modification of the invention, it is advantageous, in order to achieve the inventive objective, to engine expand the second partial stream.

Engine expansion offers the advantage that less air has to be compressed by the main air compressor. Alternatively, the additional refrigeration resultant from the engine expansion may be utilized to increase the temperature differential at the warm end, and thus at the cold end, of the first and/or second heat exchangers, so that the quantity of the second gas stream can be reduced.

In further developing the inventive process, it is suggested that before its cooling is completed, a portion of the second compressed gas stream be cooled off in heat exchange with a portion of a gas stream from the rectification to be heated in the first heat exchanger, for heat transfer purposes.

Depending upon the process conditions, the second partial stream which is yielding heat is either returned to the remainder of the second gas stream, preferably upon leaving the second heat exchanger, or is separately returned to the rectification. The gas stream absorbing the heat, after heat absorption is passed at an intermediate point to the first heat exchanger and is heated, either separately or together, with the remaining gas stream from which it was withdrawn.

In another embodiment of the invention, compression of the second gas stream is carried out in two stages, whereby a partial stream is branched off between the two steps, then is cooled in the second heat exchanger and is engine expanded before the heat exchange is completed, and subsequently is passed to rectification.

The dividing of the second gas stream has the advantage that the input pressures at the expansion engines may each be optimized in the engine expansion of the two partial streams of the second gas stream.

In another embodiment of the invention, a portion of the second gas stream compressed to its final pressure, is branched off before completion of the heat exchange, then is engine expanded and is passed to the rectification.

The branched off partial stream is expanded at a higher entrance temperature than the remainder of the second gas stream removed from the cold end of the second heat exchanger. This increases refrigeration output, and the wet vapor zone (Nassdampfzone) is avoided in expansion. An additional advantage is that only slight temperature differences occur at the cold end of the second heat exchanger.

In further developing the inventive process, it is advantageous to pass nitrogen from the rectification in part through the first and second heat exchangers, respectively, and to transfer a portion of the nitrogen from an intermediate point of the second heat exchanger to the nitrogen at an intermediate point of the first heat exchanger.

Based upon the kind of process, the second gas stream is a partial stream of the air to be fractionated or a gas stream from the high pressure stage of the two stage rectifier.

In the former case, the second gas stream is branched off before the first heat exchanger. In the latter case, a gas stream whose nitrogen content is equal to, or greater than that of air, is removed from the pressure stage, is heated in one of the two heat exchangers, or in parallel, in both heat exchangers and is subsequently compressed.

To realize additional energy savings, it is suggested that the power gained in the expansion of the second and/or third gas stream be utilized for its after-compression.

In a preferred embodiment of the process, part of the second gas stream is used as the third partial stream, whereby the second gas stream is split into two partial streams which are cooled separate from each other at different pressures in the second heat exchanger, and whereby the partial stream with the lower pressure is removed from the heat exchanger at a higher temperature than the partial stream with the higher pressure, then engine expanded and passed to the rectification.

In accordance with the invention, the high pressure gas stream which is utilized to evaporate the oxygen is divided into two partial streams of different pressures, which streams are passed separately through the heat exchanger. This measure permits variation of quantities and pressures without essential changes in compression energy. Specifically, pressure and quantity of the partial stream with the lower pressure can be selected, so that its engine expansion, which is dependent upon the entrance temperature into the expansion engine, and defined by oxygen output pressure, occurs under optimum conditions, i.e. within a pressure range which enhances maximum output. At the same time, due to the inventive premature removal of the partial stream with the lower pressure, there is a reduction of excess heat prevailing at the cold end of the second heat exchanger, and thereby also a reduction of energy loss. The pressure of the partial stream compressed to a higher pressure is variable over a wide range, thus making the oxygen output pressure also variable over a wide range.

According to another embodiment of the process, the partial stream being at higher pressure, is engine expanded after cooling. In this way, compression energy is fully utilized. The high refrigeration output resultant from the separate expansion of the two partial streams permits relatively large temperature differentials at the warm ends of the heat exchangers. Consequently, the necessary quantity of compressed air can be kept low. Furthermore, there is no compressing of supplemental air for refrigeration, i.e. the total air quantity, dependent upon the desired products to be fractionated, becomes a minimum, therefore, the dimensions of the main air compressor and the purification stage are kept as small as possible.

It is advantageous to further compress the partial stream having the lower pressure upon exiting from the first compression stage before cooling. This affords optimum utilization of energy released in the expansion and thereby keeps energy requirements for compression to the pressure desired at a minimum. The second partial stream which is passed through the heat exchanger at elevated pressure, is further compressed in the subsequent compression stage. Pressure and flow quantities may be adjusted at the compressors in such a way that the compressors operate at optimum working points, as air and oxygen are linked only indirectly. This advantage is especially valid in the partial load operation where oxygen output pressure remains high.

According to another feature of the invention, the pressure of the partial stream having lower pressure, ranges between 10 and 60 bar. The preferred pressure range is between 20 and 40 bar. The respective pressure is determined by the oxygen pressure.

In accordance with another preferred variation of the inventive process, it is advantageous to remove the partial stream, having a lower pressure, from the second heat exchanger in the area of the lowest temperature differential between the partial stream having an elevated pressure, and the oxygen.

Due to the physical conditions described above, the temperature difference at the end of the second heat exchanger is relatively large and assumes a minimum at an intermediate point of the heat exchanger. This is the preferred withdrawal point for the lower compressed partial stream. The removal of the hot gas reduces the temperature difference at the cold end of the heat exchanger and thus also reduces energy expended in the process.

In a preferred further embodiment of the invention, the power produced by one and/or both partial streams is utilized for the after-compression of one or both partial streams. The coupling of one or both expansion engines with one or both after-compressors reduces energy use.

Another feature of the invention provides that heat is transferred from an intermediate point of one heat exchanger to an intermediate point of the other heat exchanger. The heat exchange is accomplished either by indirect or direct transfer of a gas stream from one heat exchanger to the other. This measure is very effective in optimizing the temperature difference at the heat exchangers.

The invention also provides that a portion of the compressed, purified air is branched off at an intermediate point of the first heat exchanger, is engine expanded and is passed to the rectification. This can increase refrigeration output in the event that refigeration resulting from the expansion of the medium and high pressure streams is not adequate.

Here, it is especially advantageous if the branched off air portion is after-compressed before cooling.

Preferably, the second gas stream is a partial stream of the input air.

In still another embodiment of the invention, the second gas stream is removed from the pressure stage, is heated and compressed before splitting. The gas stream is either a gas stream from the lower region of the pressure stage, with a composition approximately that of air, or, a nitrogen enriched gas stream from the upper region of the pressure stage.

In a further variation of the last-mentioned embodiment, before compression of the second gas stream, a portion is branched off, is after-compressed, cooled in one of the heat exchangers, removed therefrom at an intermediate point, then is engine expanded and passed to the rectification.

The device for carrying out the inventive process comprises a main air compressor, a two stage rectifier column as well as two heat exchangers, whereby the main air compressor is connected with the pressure stage of the rectifier column via a first heat exchanger, while the second gas line has a second compressor, which is connected with the pressure stage via the second heat exchanger and an expansion engine, whereby an oxygen removal line from the low pressure stage passes through the second heat exchanger via a pump, and is characterized in that the second gas line is split into two part branches which separately transversely flow through the second heat exchanger and, whereby at least one part branch of the second gas line contains an additional compressor, while the second part branch is directed from the second heat exchanger at an intermediate point and is connected with an expansion engine whose exit is communicating with the rectifier column.

A further refinement of the device is characterized in that the second heat exchanger has several heat exchanger blocks separate from each other, of which one heat exchanger block has traverse flowing sections for an oxygen stream and a partial stream of the second gas stream whih has been compressed to higher pressure; a second heat exchanger block has traverse flowing sections for a partial stream of the higher compressed portion of the second gas stream and a nitrogen stream from the rectifier column; as well as a third heat exchanger block containing traverse flowing sections for the nitrogen stream from the second heat exchanger block and the portion of the second partial gas stream that has been compressed to a lower pressure.

This arrangement has the advantage that the gas streams passed through the second heat exchanger are almost totally independent of each other, so that the temperature conditions can be regulated in the individual heat exchanger blocks. In this manner, compressors, expansion engines, and temperature differences at the heat exchangers can be brought to their optimum, almost independently of each other.

The inventive process permits internal-compression of oxygen with energy usage reduced to the magnitude of that required for external compression of oxygen.

The process and details of the invention are described by way of the schematically depicted examples.

A BRIEF DESCRIPTION OF THE DRAWINGS

DETAILED DESCRIPTION OF THE DRAWINGS

Figure 1:
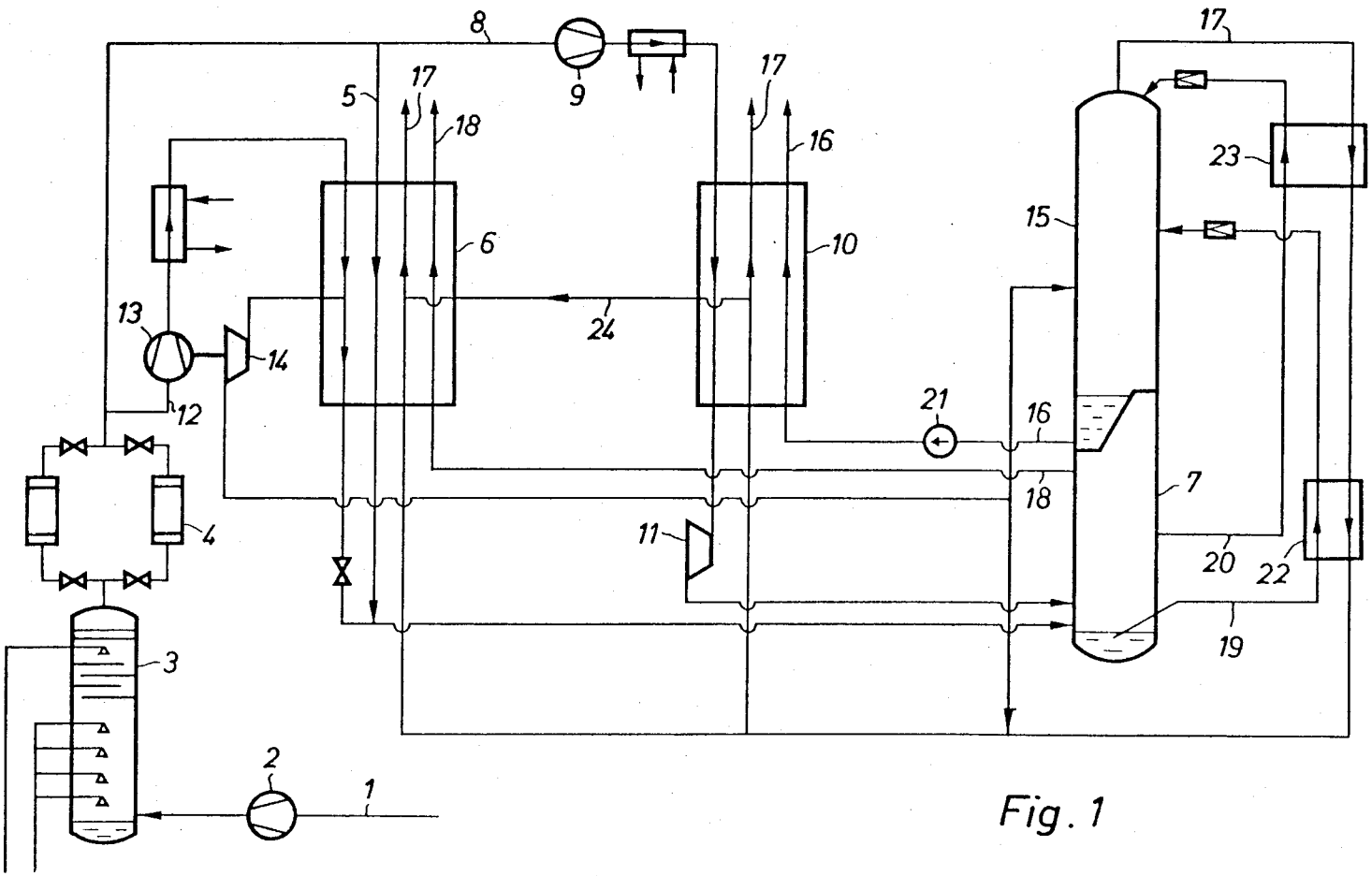
FIG. 1 shows a schematic representation of an embodiment of the invention.

In the process according to FIG. 1, air 1 is fractionated in a two-step rectification column, having a high pressure stage 7 operating at a pressure of approximately 6 bar and a low pressure stage 15 operating at a pressure of approximately 1.5 bar, into 99.5% pure oxygen which is withdrawn in liquid form via line 16, inpure nitrogen 17 which is withdrawn from the head of low pressure stage 15 and pure nitrogen 18 which is withdrawn from the head of pressure stage 7. The two rectifier stages are connected by a mutual condenser-evaporator as well as by connecting lines 19, 20. Oxygen in liquid form is compressed to the desired output pressure, e.g. 70 bar, by way of pump 21.

Air 1 is initially compressed in a main air compressor 2 to about 6 to 7 bar, is cooled in a spray zone cooler (Spruehzonenkuehler) 3, and $CO_2$ and $H_2O$ are removed in a pair of commutable sieve absorbers (Molsiebadsorber) 4. The air is subsequently split into three partial streams. The largest partial stream 5 is cooled to about 100° K. in first heat exchanger 6 in heat exchange with impure nitrogen 17, which has been previously heated in heat exchange with fraction 19, 20 (heat exchangers 22, 23), and with pure nitrogen 18 and is then passed to pressure stage 7.

Second partial stream 8 is further compressed by compressor 9 to a pressure of about 75 bar and after removal of the compression heat, is cooled in second heat exchanger 10 by heat exchange with the evaporating product oxygen 16. The pressure of second partial stream 8 depends on the pressure of the oxygen to be evaporated. For heat balance reasons and to prevent large temperature differences at the warm end of first heat exchanger 6, a portion of impure nitrogen 17, in addition to the oxygen, is heated in second heat exchanger 10.

Second partial stream 8 is then engine expanded in turbine 11 to the pressure of the pressure stage, and is then passed to pressure stage 7.

In accordance with the invention, as third partial stream 12, a portion of the purified air is further compressed in compressor 13 to a pressure of about 8 to 10 bar and is cooled in first heat exchanger 6 after removal of compression heat. A portion of the third partial stream is withdrawn at an intermediate point from first heat exchanger 6 at a temperature of about 140° to 150° K., is engine expanded (turbine 14) and is partially or entirely passed to low pressure stage 15 to enhance rectification. Compressor 13 is coupled with turbine 14 for transfer of turbine output. The remainder of the turbine stream is mixed with impure nitrogen 17. As depicted in the drawing, the mixing step occurs subsequent to heat exchangers 22, 23. However, if required, it can take place between these heat exchangers. Also, under certain conditions, it may be more advantageous to add the entire turbine stream to impure nitrogen 17.

Due to the high specific heat content of air below the critical point, there is a substantial amount of heat available at the cold end of second heat exchanger 10 for heating a corresponding amount of impure nitrogen 17. In accordance with another feature of the invention, heat from the second heat exchanger 10 is transferred to an intermediate point of first heat exchanger 6 by diverting a portion of nitrogen 17 in line 24 after heating in the lower third of second heat exchanger 10. The gas stream passed through line 24 is mixed with the partial stream of impure nitrogen 17 passed through first heat exchanger 6, as shown in the example, and is heated together therewith, or separately therefrom (latter not depicted).

The smaller the amount of nitrogen 17 to be heated in second heat exchanger 10, the smaller the quantity of air which must be compressed in compressor 9. At the same time, the heat transfer permits the drawing-off of third partial stream 12 for refrigeration in turbine 14, whereby the withdrawal occurs approximately at that point of first heat exchanger 6 where the heat is added. In first heat exchanger 6, large temperature differences occur at the ends, and small temperature differences occur in the center, with a heat excess in streams 17, 18. The increased heating of products to be fractionated, in first heat exchanger 6, further reduces the quantity of air to be compressed in compressor 9.

Figure 2:
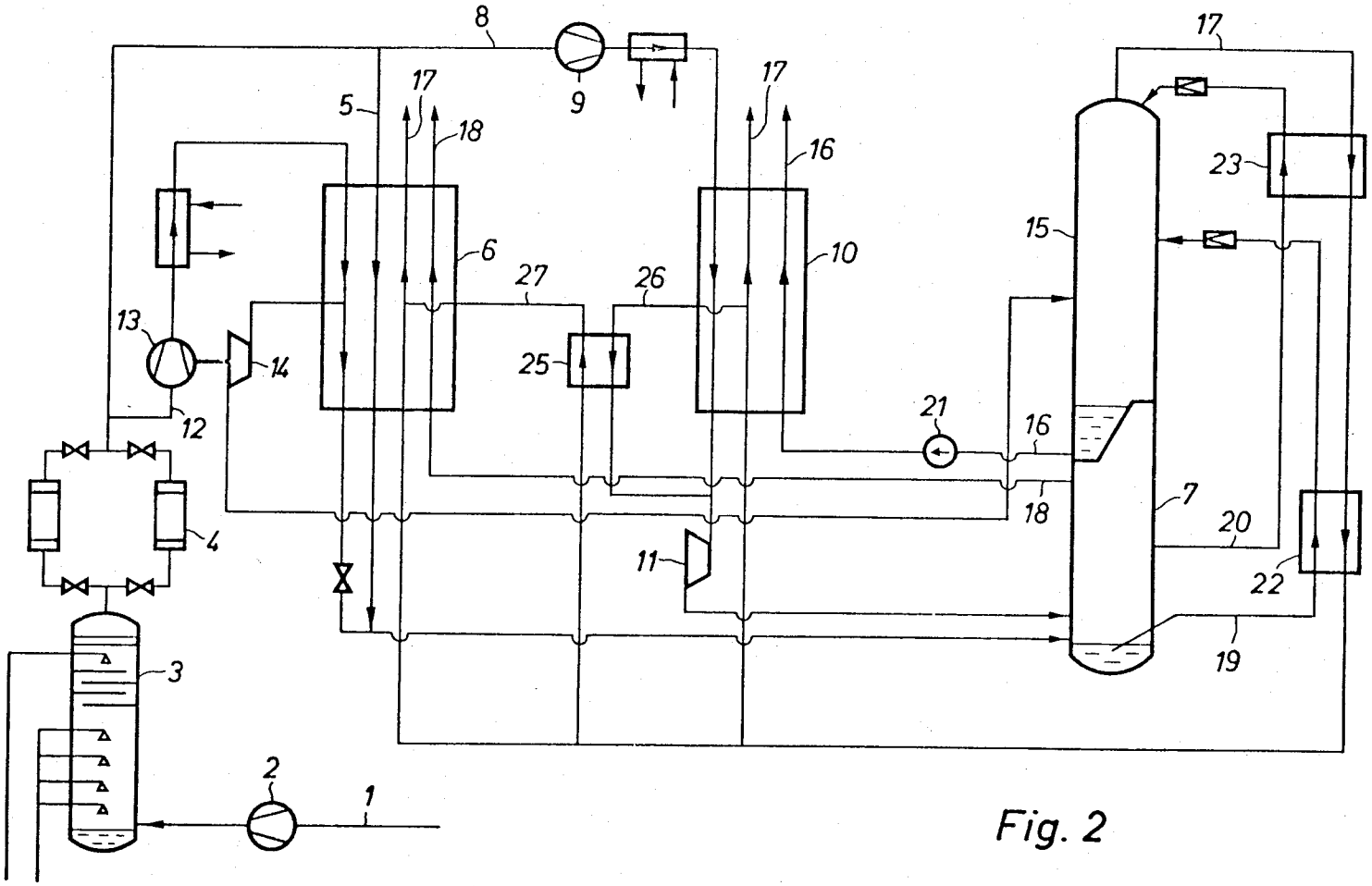
FIG. 2 shows a schematic representation of another embodiment of the invention.

The variation according to FIG. 2, in which, as in the other figures, analog parts have identical reference numerals, shows that in contrast to the process according to FIG. 1, there is an indirect exchange in heat exchanger 25 instead of a direct heat transfer between heat exchangers 6, 10. Partial stream 26 of nitrogen stream 17 is removed from the lower third of second heat exchanger 10 and is heat exchanged with partial stream 27 of nitrogen 17, which subsequently is passed to first heat exchanger 6 at an intermediate point. Partial stream 26 is returned to remaining second air stream 8 before its expansion or, (not depicted) is directly passed to pressure stage 7. Partial stream 27 is added to nitrogen 17, and together or separately (not depicted), is passed to the warm end of heat exchanger 6.

Figure 3:
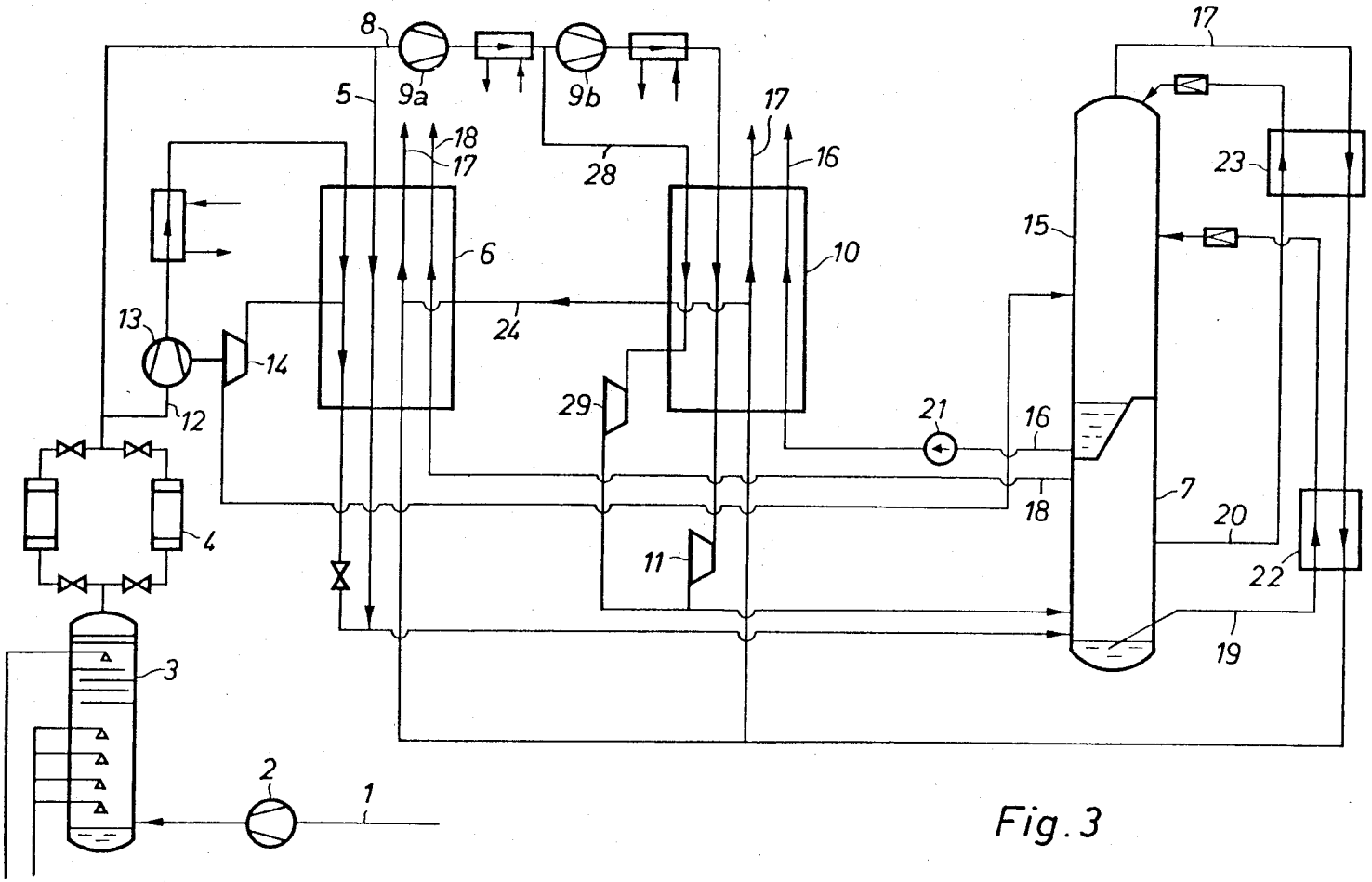
FIG. 3 shows a schematic representation of another embodiment of the invention.

FIG. 3. shows a variation of the process, in which, as in FIG. 1, a direct heat transfer takes place via line 24. In contrast thereto, the second gas stream is compressed in two stages (compressors 9*a*, 9*b*). The pressure behind compressor 9*a* is approximately 30–40 bar, and behind compressor 9*b* it is approximately 75 bar. Between compressors 9*a*, 9*b*, partial stream 28 is branched off, passed through a portion of second heat exchanger 10 and is withdrawn at an intermediate point in the lower third thereof. This partial stream is engine expanded in turbine 29 and is passed to pressure stage 7, together with the remainder of the second air stream which has been compressed to higher pressure and has been expanded in turbine 11, or (not depicted), is passed separately therefrom to pressure stage 7. Turbine 29 operates at a higher entrance temperature than turbine 11. Therefore, it has a higher refigeration performance and additionally does not operate in the wet vapor zone. An added advantage is that the temperature differences are reduced at the cold end of the second heat exchanger 10, so that the energy losses during heat exchange are minimized.

Figure 4:
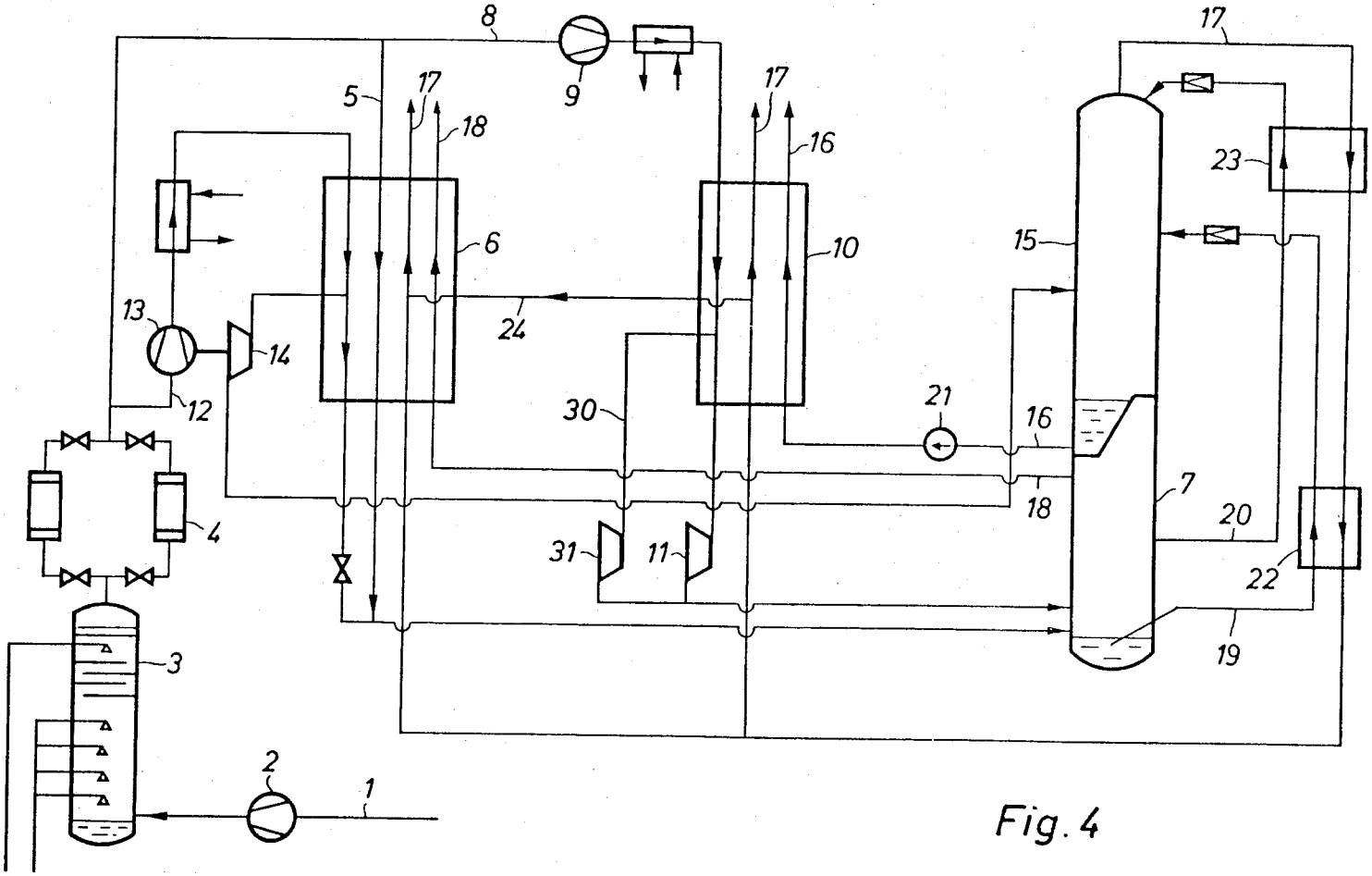
FIG. 4 shows a schematic representation of another embodiment of the invention.

The variation of the process depicted in FIG. 4 differs from the one in FIG. 1, in that a portion of the second air stream is expanded by the full pressure of compressor 9, while FIG. 3 shows expansion by intermediate pressure. Partial stream 30 is branched off from the second air stream at an intermediate point of second heat exchanger 10 and is engine-expanded in turbine 31. Subsequently, this partial stream, together with the remainder of the second air stream which is expanded in turbine 11, is passed into pressure stage 7, or is passed separately therefrom (not depicted) into pressure stage 7.

Figure 5:
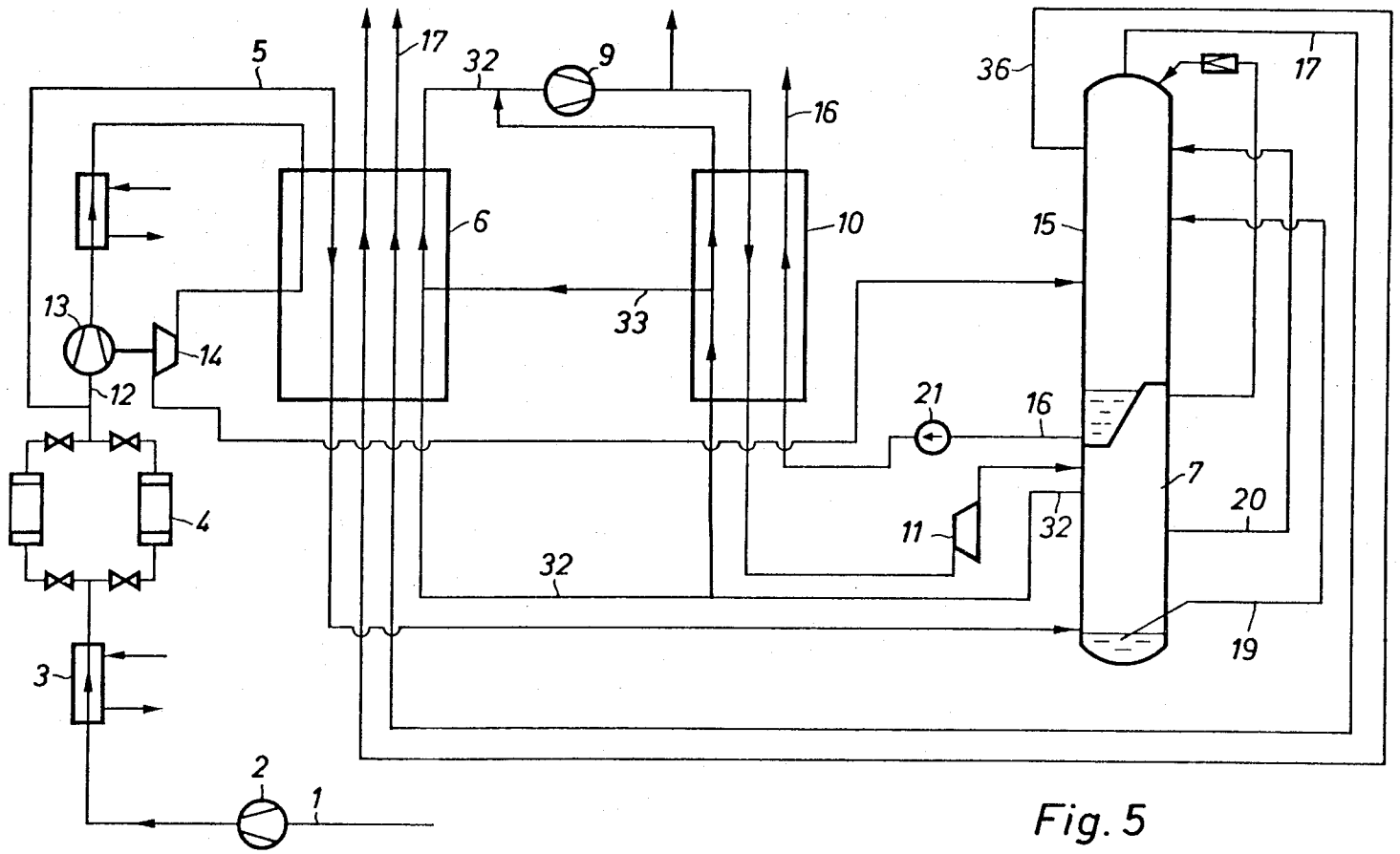
FIG. 5 shows a schematic representation of another embodiment of the invention.

An analog procedure to FIG. 1 is shown in FIG. 5, with however, the distinction that the second partial gas stream, which is compressed to an elevated pressure, is nitrogen enriched gas stream 32 which is removed from the upper region of pressure stage 7. Nitrogen 32 (which has been split into two streams) is respectively partially heated in the two heat exchangers 6, 10. The two streams are subsequently jointly compressed (compressor 9) and then are cooled in heat exchange with liquid oxygen in heat exchanger 10, engine expanded (turbine 11) and are returned to pressure stage 7, above the point of removal. Again, in accordance with the invention, heat is transferred from an intermediate point of second heat exchanger 10 by nitrogen enriched stream 33 which is branched off of nitrogen enriched partial stream 32 at an intermediate point of second heat exchanger 10 and added to the nitrogen enriched partial stream 32 at an intermediate point in first heat exchanger 6. As an alternative (not depicted) stream 33, independent of partial stream 32, may be passed to the warm end of heat exchanger 6. An additional nitrogen stream 36 is removed from the upper region of low pressure stage 15 and is heated in first heat exchanger 6.

Figure 6:
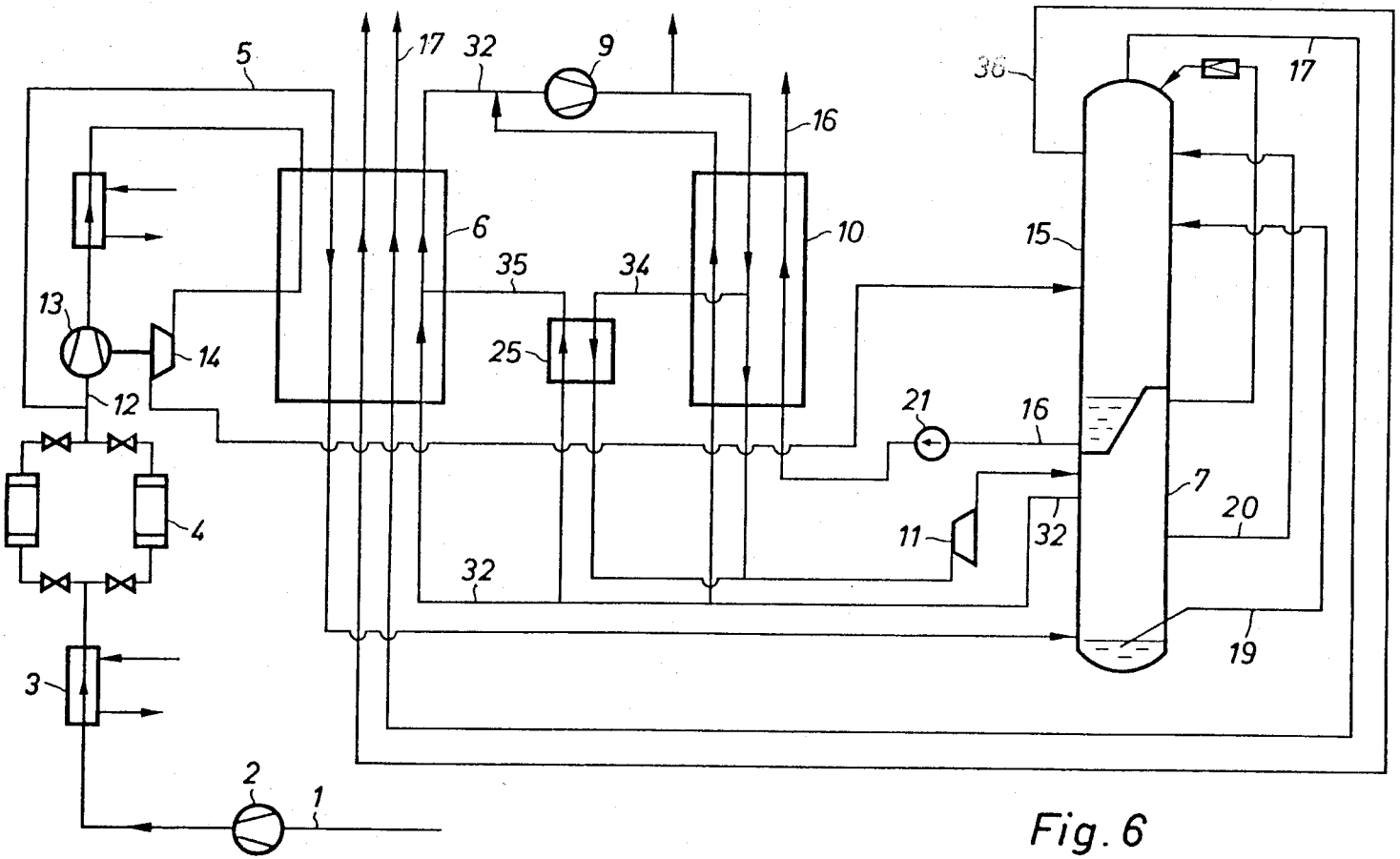
FIG. 6 shows a schematic representation of another embodiment of the invention.

The process according to FIG. 6 is analog to that according to FIG. 2, however, here again, the second gas stream is nitrogen stream 32 from pressure stage 7. The inventive transfer from second heat exchanger 10 to first heat exchanger 6 occurs by indirect heat exchange in heat exchanger 25. At an intermediate point of second heat exchanger 10, a partial stream 34 of compressed nitrogen 33 is branched off, cooled in heat exchanger 25 and is mixed with the remainder of nitrogen exiting at the cold end of heat exchanger 10. As an alternative (not depicted), partial stream 34 may be expanded from the remainder of nitrogen and be passed to pressure stage 7. Portion 35, of the partial quantity of nitrogen 32 to be heated in heat exchanger 6, is removed, then absorbs heat from partial stream 34 in heat exchanger 25, and subsequently is added to the quantity of nitrogen 32 passed through heat exchanger 6 at an intermediate point. Alternatively, partial stream 35 (not depicted) may be passed separately to the warm end of heat exchanger 6.

Figure 7:
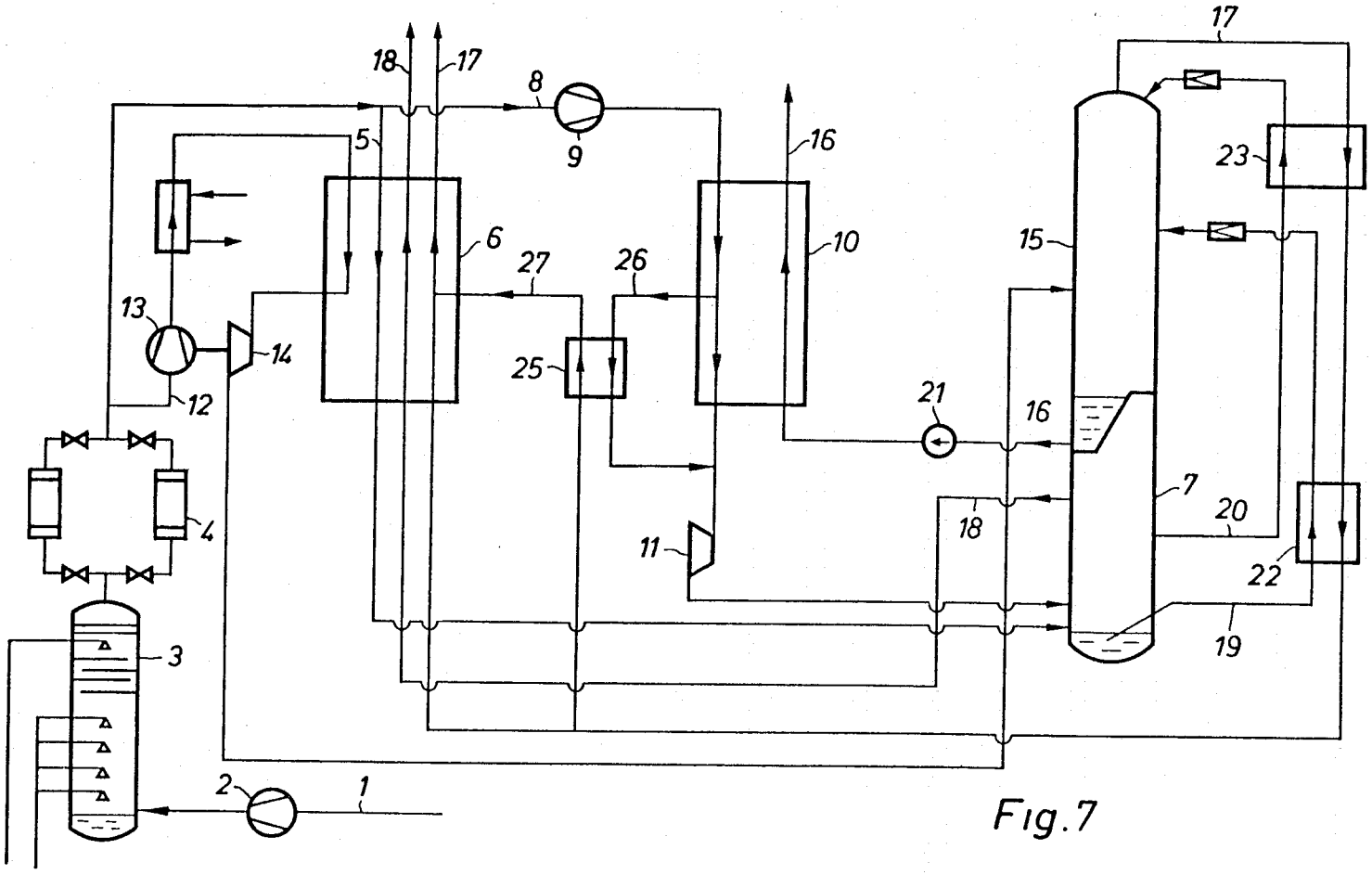
FIG. 7 shows a schematic representation of another embodiment of the invention.

FIG. 7 shows a variation of the inventive process, in which, contrary to the process of FIG. 2, the entire third partial stream 12 is expanded in turbine 14. Another variation of this Figure is that nitrogen 17 from the head of low pressure stage 15 is passed through first heat exchanger 6 only, whereby here also a portion of nitrogen 17 is branched off before heat exchanger 6, and after heat absorption is heat exchanger 25 is passed to heat exchanger 6 at an intermediate point, and then, together with the remaining amount of nitrogen 17 is further heated. Stream 27 (not depicted) may also separately from nitrogen 17, be passed to the warm end of heat exchanger 6.

Figure 8:
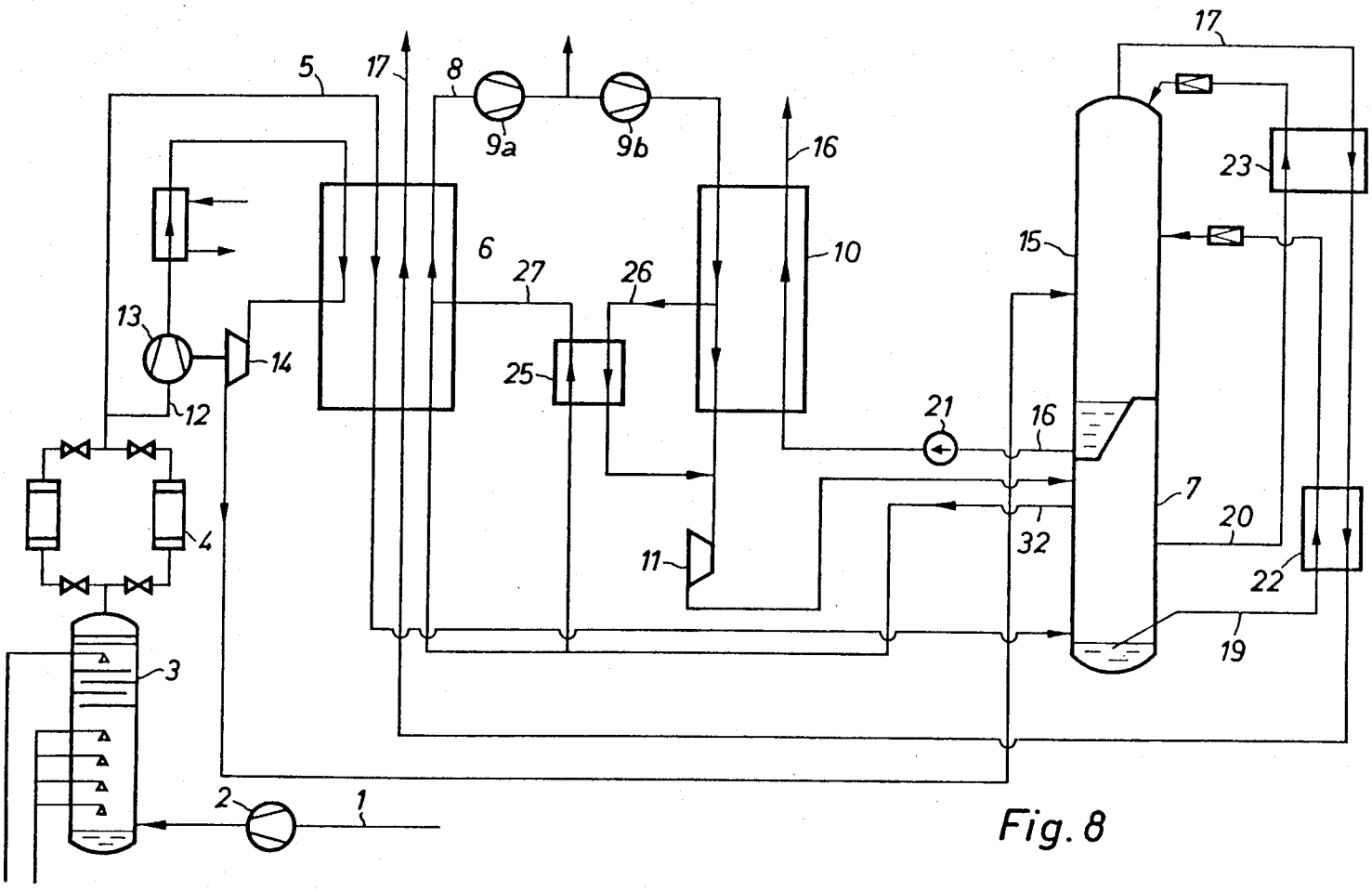
FIG. 8 shows a schematic representation of another emboidment of the invention.

The process according to FIG. 8 merely differs from the one depicted in FIG. 7 in that the second gas stream is nitrogen 32 from pressure stage 7. Moreover, compression of the second gas stream occurs in two compressor steps, *9a* and *9b*.

Figure 9:
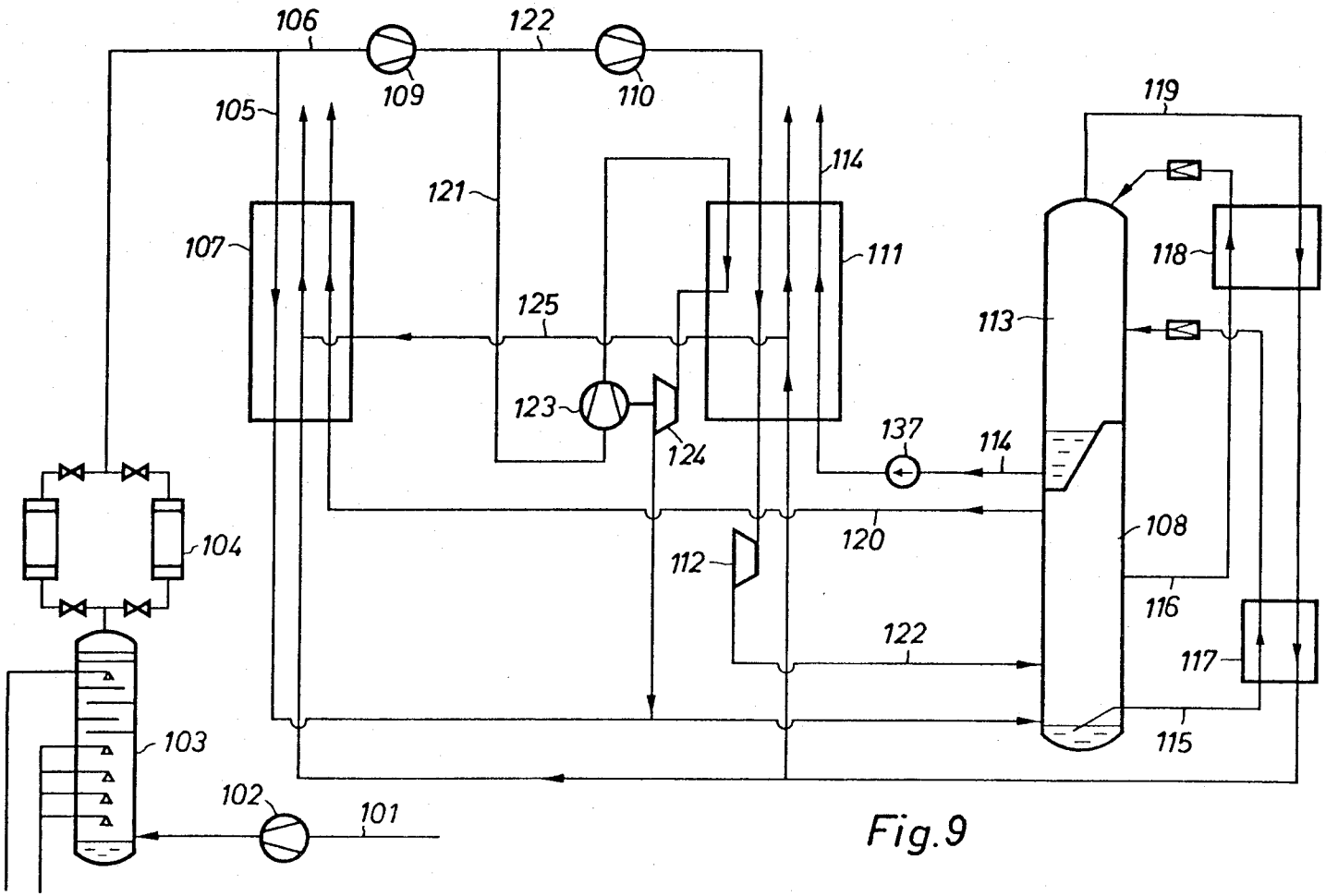
FIG. 9 shows a schematic representation of another embodiment of the invention.

According to FIG. 9, air 101 is compressed to approximately 6 bar in main air compressor 102, then is cooled in spray zone cooler 103 (Spruehzonenkuehler) and $CO_2$ and $H_2O$ are removed therefrom by commutable molecular sieve absorbers 104. Subsequently, the purified air is separated into two air streams 105, 106. Air stream 105 which is larger in quantity, is cooled in first heat exchanger 107 in heat exchange with nitrogen 119, 120 from the rectification and is introduced into pressure stage 108 of the two-stage rectifier column. Second air stream 106 is compressed in compressors 109, 110 to a higher pressure (approximately 75 bar), and is cooled in second heat exchanger 111 in heat exchange with nitrogen and oxygen from the rectification, subsequently it is engine-expanded in turbine 112 to the pressure of pressure stage 108 (approximately 5.9 bar), whereby, for example, more than 90% of the air is liquefied then is passed into pressure stage 108. Liquid oxygen with a purity of 99.5% for instance (line 114), is removed from low pressure stage 113 of the rectifier column and is pumped to the desired output pressure by pump 137 and is evaporated and heated in heat exchanger 111. Output pressure in the depicted example is approximately 70 bar.

The two stages of the rectifier column are connected by connection lines 115, 116. Nitrogen 119 from the head of the low pressure stage is heated in heat exchangers 117, 118 in heat exchange with the preliminiary products 115, 116, whereby these are simultaneously supercooled. Nitrogen 119 in two parts, respectively, is passed through heat exchangers 107, 111 and is heated. Nitrogen 120 from the head of pressure stage 108 is heated in heat exchanger 107.

In accordance with the invention, second air stream 106 is further divided into two partial streams 121, 122 with different pressures. The first partial stream 122 is referenced above (second air stream 106) as being compressed in compressor 110. Second partial stream 121 is formed by an air stream branched off between compressors 109, 110. Air stream 121 is compressed in compressor 123 from a pressure of approximately 25 bar to a pressure that remains lower than the pressure of partial air stream 122 which is compressed in compressor 110 (approximately 33 bar), and is then cooled in second heat exchanger 111. Air stream 121 is withdrawn from heat exchanger 111 at a temperature which is higher that the removal temperature of partial air stream 122, is engine-expanded in turbine 124 and is then passed to pressure stage 108 together with air stream 105. The withdrawal from second heat exchanger 111 occurs below the point at which there is the lowest temperature difference between the cold and the warm streams. For example, the temperature at the inlet to turbine 124 might be 149° K., while at turbine 112 it could be 103° K. Turbine 124 transfers its output to compressor 123.

The refrigeration performance of turbine 124 furnishes about 80–90% of the refrigeration of the plant, and that of turbine 112 provides the remainder.

According to another feature of the invention, a portion of nitrogen 119 is branched off at an intermediate point of heat exchanger 111 and is added to the nitrogen passing through heat exchanger 107 at an intermediate point (line 125). With this measure, heat is transferred from the second to the first heat exchanger.

Figure 10:
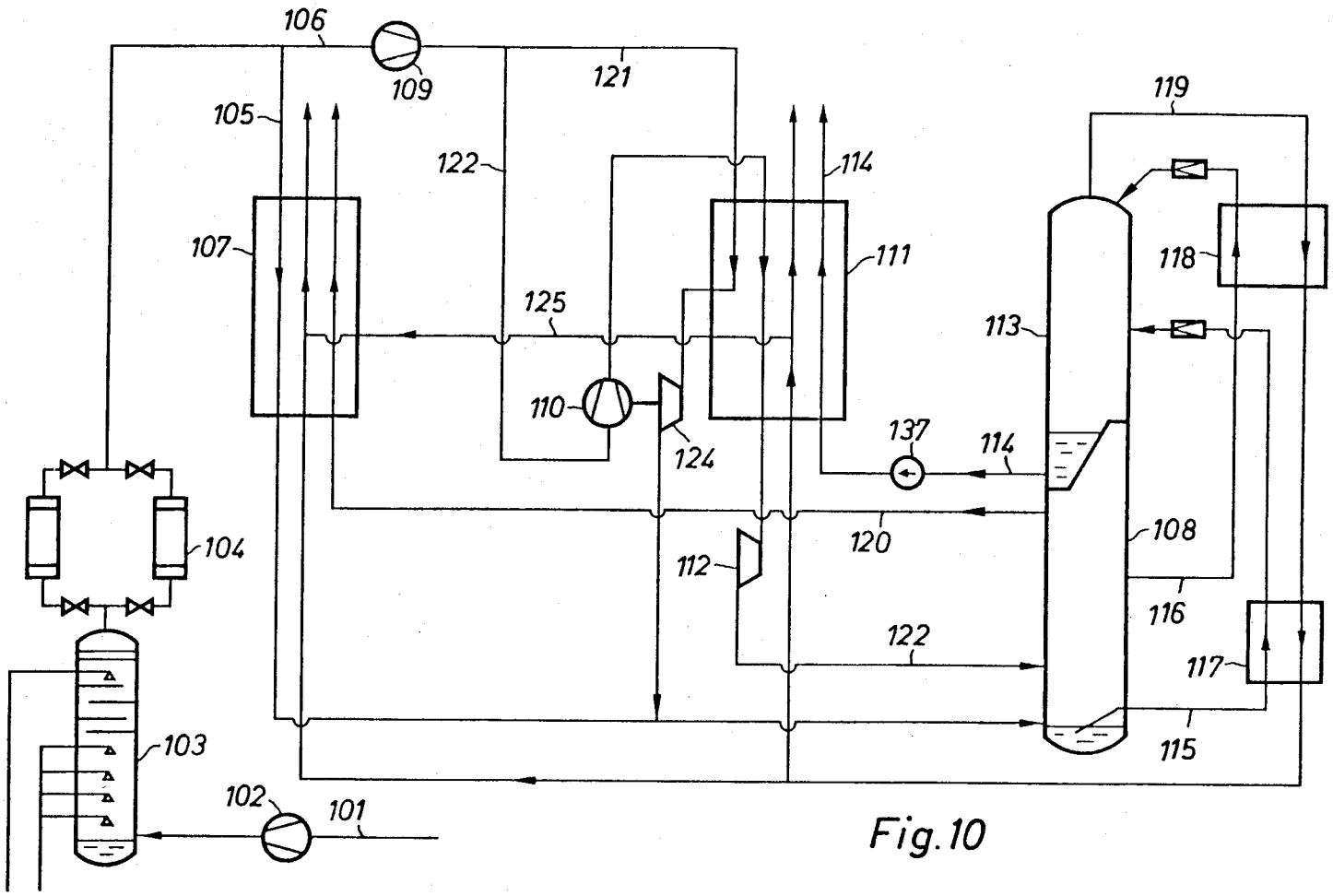
FIG. 10 shows a schematic representation of another embodiment of the invention.

The process according to FIG. 10 differs from the one depicted in FIG. 9 with regard to the direction of air streams 121 and 122. For the remaining analog components, identical reference numerals to those of FIG. 9 were used, and will be used in the following figures.

Second partial air stream 121 which has been compressed in compressor 109 to approximately 52 bar, is cooled in part at this pressure in second heat exchanger 111, is then withdrawn at an intermediate point therefrom and is engine expanded in turbine 124 to the pressure of pressure stage 108, into which it is subsequently passed, together with air stream 105. Second partial stream 122 is compressed to a higher pressure (approximately 65 bar) in compressor 110, is cooled in second heat exchanger 111. At its cold end, air stream 122 is removed, expanded in turbine 112 to the pressure of pressure stage 108 and then is passed into the pressure stage. Turbine 124 is connected to compressor 110.

Figure 11:
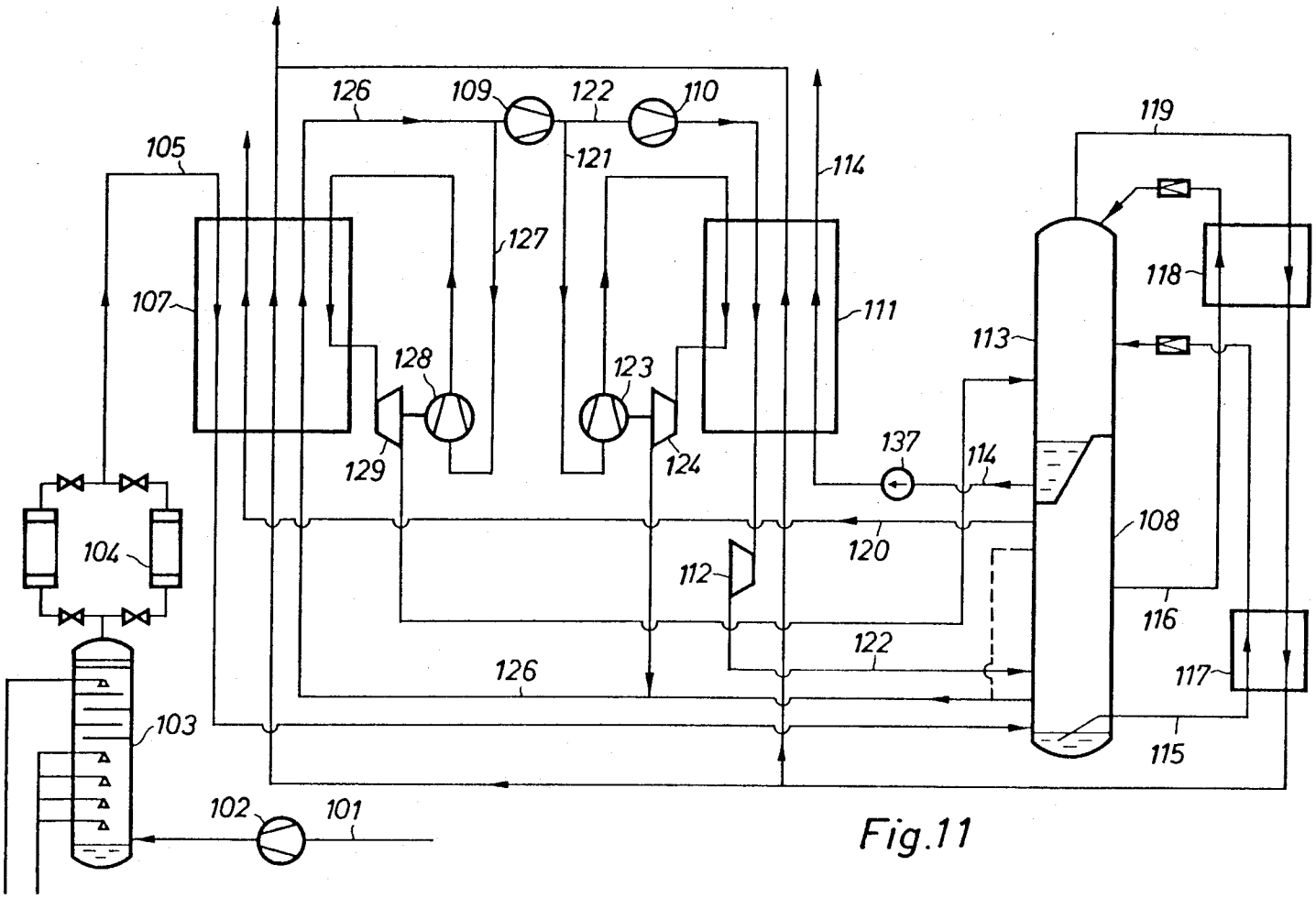
FIG. 11 shows a schematic representation of another embodiment of the invention.

FIG. 11 shows a variation of the process in which a recycle gas (Kreislaufgas) comprises the second gas stream. Gas stream 126 is withdrawn from the rectification as recycle gas. In the example depicted, the withdrawal is in the lower region of pressure stage 108, i.e. the second gas stream has a composition approximating that of air. Basically, it is also possible, for example, to utilize nitrogen enriched gas from the upper region of pressure stage 108 as recycle gas (dotted illustration).

Recycle gas 126 is heated in first heat exchanger 107 to approximately ambient temperature, is compressed in compressor 109, 110, and is cooled in second heat exchanger 111 in heat exchange with evaporating oxygen, then is engine expanded in turbine 112 and is passed into pressure stage 108. Before it reaches compressor 109, portion 127 of the second gas stream is branched off, compressed to a pressure of approximately 6–10 bar in compressor 128 and is cooled in a portion of first heat exchanger 107. At an intermediate point, this gas stream is withdrawn, expanded in turbine 129, which is connected to compressor 128, to the pressure of low pressure stage 113 and is passed into the low pressure stage. Gas stream 127 is utilized for refrigeration.

Partial stream 121 is branched off between compressors 109, 110, is further compressed in compressor 123 and is cooled in a portion of second heat exchanger 111. At an intermediate point, part stream 121 is withdrawn at a higher temperature than that prevailing at the cold end of second heat exchanger 111, then is expanded to the pressure of the pressure stage in turbine 124, which is connected with compressor 123, and subsequently is added to recycle gas 126.

Figure 12:
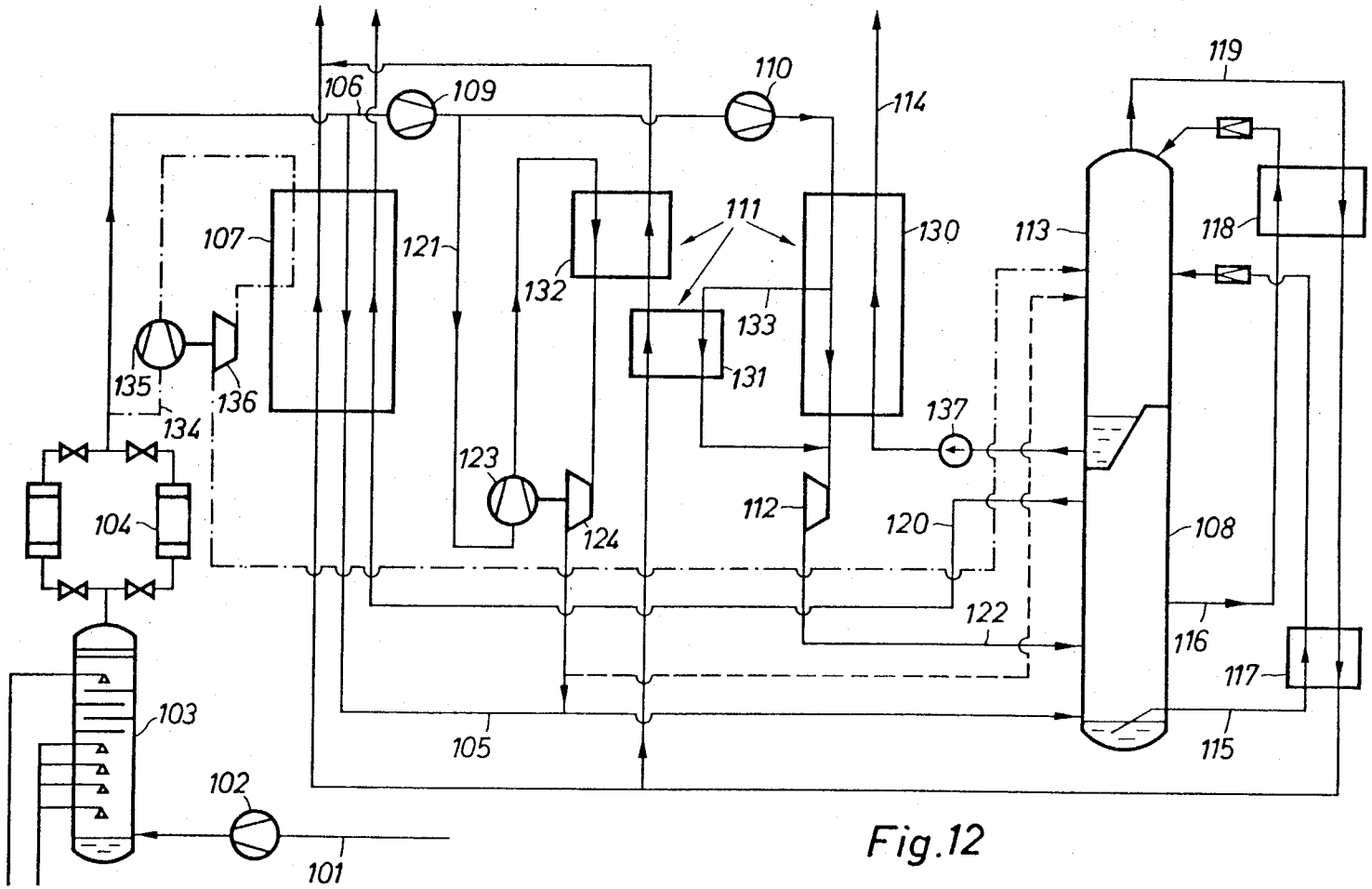
FIG. 12 shows a schematic representation of another embodiment of the invention.

FIG. 12 shows a process similiar to that of FIG. 9, in which the second heat exchanger consists of three separated heat exchanger blocks 130, 131, 132. Another difference is the absence of connecting line 125.

Part stream 122, compressed to higher pressure, is cooled in heat exchanger block 130 in heat exchange with the evaporating oxygen. Portion 133 of part stream 122 is removed from heat exchanger block 130 at an intermediate point and is cooled in heat exchanger block 131 in heat exchange with nitrogen portion 119 from the head of low pressure stage 113, then is engine expanded in turbine 112 together with the remainder of part stream 122 which has been cooled in heat exchanger block 130, and is passed to pressure stage 108.

Part stream 121, branched off between compressors 109, 110 after compression in compressor 123, is then cooled in heat exchanger block 132 in heat exchange with partial nitrogen stream 119, which has been preheated in heat exchanger block 131, subsequently is engine expanded in turbine 124 and is passed into pressure stage 108. Depending upon the process conditions, particularly depending upon oxygen output pressure, the air expanded in turbine 124, alternatively can be passed into low pressure stage 113 (dotted illustration).

The division of heat exchanger 111 into three separate heat exchanger blocks 130, 131, 132 permits extensive variation of pressures, quantities and temperatures of air streams 121, 122, respectively, independent of each other, at preset oxygen output pressure, and thus permits selection of optimum working points for compressors and turbines. This applies particularly to the inlet temperature at turbine 124 which can be chosen independent of the temperature difference to be maintained for evaporating the oxygen.

Moreover, FIG. 12 shows another variation of the invention process (dash-dotted illustration) in which a partial stream 134 of the compressed, purified air 101 is further compressed in compressor 135, is withdrawn at an intermediate point from first heat exchanger 107, engine expanded in turbine 136, and is then passed to low pressure stage 113.

The inventive process permits internal-compression of oxygen with energy usage reduced to the magnitude of that required for external-compression of oxygen.

The invention has been described with reference to specific embodiments. Modifications and variations of those embodiments are within the scope of the invention, which is defined in the following claims.

What is claimed is:

1. Process for the production of gaseous O at an elevated pressure by low temperature rectification of air, comprising reducing energy requirements for production of oxygen by compressing, purifying and at least in part cooling the air in a first heat exchange in heat exchange with rectification product, passing the air to the rectification, compressing a second gas stream to a higher pressure, cooling the second gas stream, after compressing, in a second heat exchanger in heat exchange with rectification product, withdrawing heat at an intermediate point along the second heat exchanger, whereby temperature differences at a cold end of the second heat exchanger are reduced, adding the withdrawn heat to the first heat exchanger, whereby less air is required for heating at a cold end of the first heat exchanger, expanding the second gas stream, after cooling, and passing the second gas stream, after expanding to the rectification, and cooling a third gas stream to be fractionated in heat exchange with fractionation product, liquid oxygen being withdrawn from the rectification, and being pumped to the desired pressure, and, in heat exchange with the compressed gas stream, being evaporated and heated, whereby energy requirements for the production of oxygen is reduced.

2. Process according to claim 1, characterized in that the third gas stream is further compressed before cooling.

3. Process according to claim 1, characterized in that the third gas stream after expansion is passed either to the rectification or into nitrogen, drawn off from the rectification.

4. Process according to claim 1, characterized in that the third gas stream is removed from first heat exchanger, essentially at the point where heat is added.

5. Process according to claim 1, characterized in that the second partial stream is engine expanded.

6. Process according to claim 1, characterized in that for heat transfer purposes, a portion of the second compressed gas stream, before cooling is complete, is cooled in heat exchange with a portion of gas stream from the rectification, which is to be heated in the first heat exchanger.

7. Process according to claim 1, characterized in that the compression of the second gas stream occurs in two steps, whereby between the two steps a partial stream branches off, is cooled in a second heat exchanger and before heat exchange is completed, is engine expanded and passed into the rectification.

8. Process according to claim 1, characterized in that a portion of second gas stream, compressed to its final pressure, branches off before completion of the heat exchange, is engine expanded and passed into the rectification.

9. Process according to claim 1, characterized in that nitrogen from the rectification, is passed through the first and the second heat exchanger, in part, respectively, and a portion of the nitrogen is transferred from an intermediate point of the second heat exchanger to the nitrogen at an intermediate point of first heat exchanger.

10. Process according to claim 1, characterized in that the second gas stream is a partial stream of the air to be fractionated or a gas stream from the high pressure stage.

11. Process according to claim 1, characterized in that the power gained in the expansion of the second and/or third gas stream is used for its compression.

12. Process according to claim 1, characterized in that a portion of the second gas stream is used as the third partial stream, whereby the second gas stream is split into first and second partial streams, which are cooled in the second heat exchanger, separate from each other, at different pressures, and in that a partial stream having the lower pressure, is removed from the second heat exchanger at a higher temperature than the higher compressed second partial stream, thereupon is engine expanded and, at least in part, is passed to the rectification.

13. Process according to claim 12, characterized in that the second partial stream, being at elevated pressure, is engine expanded after cooling.

14. Process according to claim 12, characterized in that the first partial stream, being at lower pressure, after exiting from the first compression stage, is after-compressed before cooling.

15. Process according to claim 12, characterized in that the pressure of the first partial stream, having the lower pressure, ranges between 10 and 60 bar.

16. Process according to claim 12, characterized in that the first partial stream, having the lower pressure, is withdrawn from the second heat exchanger in the area of the smallest temperature differential between the second partial stream, having the higher pressure, and oxygen.

17. Process according to claim 12, characterized in that the output realized in the expansion of one or both partial streams is utilized for the after-compression of one or both partial streams.

18. Process according to claim 12, characterized in that heat is transferred from an intermediate point of one heat exchanger to an intermediate point of the other heat exchanger.

19. Process according to claim 12, characterized in that a portion of the compressed, purified air is branched off at an intermediate point of the first heat exchanger, is engine expanded and passed into the rectification.

20. Process according to claim 19, characterized in that the branched off portion of air is after-compressed before cooling.

21. Process according to claim 12, characterized in that the second gas stream is a partial stream of the incoming air.

22. Process according to claim 12, characterized in that the second gas stream is withdrawn from pressure stage and is heated and compressed before the splitting.

23. Process according to claim 22, characterized in that before compression of the second gas stream, a portion is branched off and is after-compressed, cooled in one of the heat exchangers, is withdrawn therefrom at an intermediate point, is engine expanded and passed into the rectification.

24. Process according to claim 1, characterized in that as said third gas stream a portion of the compressed purified air is cooled in the first heat exchanger, then is removed at least in part, at an intermediate point therefrom, and is engine expanded.

* * * * *